US005558548A

United States Patent [19]

Olofsson et al.

[11] Patent Number: 5,558,548

[45] Date of Patent: Sep. 24, 1996

[54] PROPELLER DRIVE FOR BOATS

[75] Inventors: Niclas Olofsson, Väse; Anders Rydberg, Arboga; Oddbjörn Hallenstvedt, Valskog, all of Sweden

[73] Assignee: AB Volvo Penta, Gothenburg, Sweden

[21] Appl. No.: 341,581

[22] PCT Filed: May 17, 1993

[86] PCT No.: PCT/SE93/00434

§ 371 Date: Jan. 24, 1995

§ 102(e) Date: Jan. 24, 1995

[87] PCT Pub. No.: WO93/24361

PCT Pub. Date: Dec. 9, 1993

[30] Foreign Application Priority Data

May 22, 1992 [SE] Sweden ..... 9201625

[51] Int. Cl.[6] ..... B63H 1/28; B63H 5/12

[52] U.S. Cl. ..... 440/66; 440/75; 440/78; 440/83

[58] Field of Search ..... 440/75, 79, 82, 440/83, 66, 78, 51; 114/152, 271, 291

[56] References Cited

U.S. PATENT DOCUMENTS

| | | | |
|---|---|---|---|
| 2,162,058 | 6/1939 | Brush | 440/79 |
| 2,909,140 | 10/1959 | Kiekhaefer | 114/291 |
| 3,368,420 | 2/1968 | Alexander, Jr. | 440/75 |
| 3,952,678 | 4/1976 | Weston | 114/291 |
| 4,435,110 | 3/1984 | Hunkeler | 74/409 |
| 4,609,360 | 9/1968 | Whitehead | 440/69 |
| 4,728,308 | 3/1988 | Weismann | 440/83 |
| 4,775,342 | 10/1988 | Connor | 440/75 |
| 4,810,218 | 3/1989 | Iwai | 440/66 |

FOREIGN PATENT DOCUMENTS

| | | | |
|---|---|---|---|
| 0254959 | 2/1988 | European Pat. Off. . | |
| 61-178294 | 8/1986 | Japan . | |
| 0020494 | 1/1990 | Japan | 440/78 |

*Primary Examiner*—Sherman Basinger
*Attorney, Agent, or Firm*—Young & Thompson

[57] ABSTRACT

Propulsion unit for marine vessels with a gear or bearing housing (6) in which a propeller shaft (7) with a surface-breaking propeller (8) is carried. In a horizontal plane the propeller shaft forms an angle ($\alpha$) to a guide fin (9) so as to create a resultant force (R) of the pressure force (P) of the propeller and the side force (S), with the resultant force being aligned with the longitudinal direction ($C_L$) when the vessel is travelling straight ahead.

12 Claims, 4 Drawing Sheets

PROPELLER DRIVE FOR BOATS

FIELD OF THE INVENTION

The present invention relates to a propulsion unit for marine vessels, the unit comprising a housing connected to the hull of the vessel and the housing incorporating a propeller shaft provided with a surface-breaking propeller.

BACKGROUND OF THE INVENTION

Until now, known propulsion units of this type, whether they be purely outboard motors or so called inboard propulsion units with totally submerged or surface-breaking propellers, have had propeller shafts which, when the boat is travelling straight ahead, have been aligned with the longitudinal extension of the boat. In other words, the propeller shaft has always been parallel to the usual steer fin on outboard motors and inboard propulsion units.

When powered by surface-breaking propellers, water is accelerated both in the axial direction and sideways, whereby the sideways forces generated by the sideways acceleration in previously known propulsion units has solely resulted in pure losses of kinetic energy, which is comparable with the rotation of the slip stream in conventional propellers. The resultant of the propeller pressure force in the longitudinal direction and the sideways force can, when large sideways forces are present, deviate so much from the longitudinal direction that it has been necessary to compensate for this by setting the rudder of the vessel (with fixed drive units), or the entire propulsion unit (with simple steerable units), at an angle, with consequential increase in the flow resistance. In twin installations, the counter-rotating propellers do not require any oblique setting of the propulsion unit or rudder since the side forces act in opposite direction and do not generate any steering forces, though the losses remain and the side forces must be taken up in steering components, tie-rods and suspension members.

SUMMARY OF THE INVENTION

It is an object of the present invention to provide a propulsion unit of the previously mentioned type in which the above mentioned losses and the loading of, for example, the tie-rod arrangements and associated components can be eliminated.

This is achieved in accordance with the present invention in a manner such that, in the horizontal plane, the propeller shaft forms an angle to a vertical plane of symmetry of a flow-control body connected to, or integral with, said housing, said body being intended to be aligned with the longitudinal extension of the vessel when the vessel is travelling in a straight line. With steerable propulsion units having a steer fin, the propeller shaft is angled primarily with respect to the steer fin so that the fin is aligned with the longitudinal extension of the vessel when the propeller shaft is obliquely set, so that the resultant of the propeller pressure force and the propeller side force will act essentially in the longitudinal direction.

In a preferred embodiment of the propulsion unit according to the invention, two oppositely rotating propeller shafts are located in the housing in a common, substantially horizontal plane. The shafts form an included angle which is bisected by a steer fin.

BRIEF DESCRIPTION OF THE DRAWINGS

The invention will be described in greater detail in the following with reference to the embodiments shown in the attached drawings in which.

DETAILED DESCRIPTION OF THE INVENTION

Figure 2:
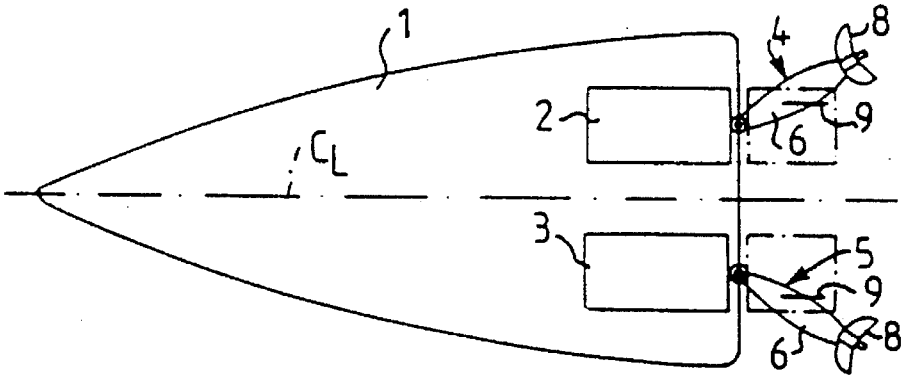
Figure 3:
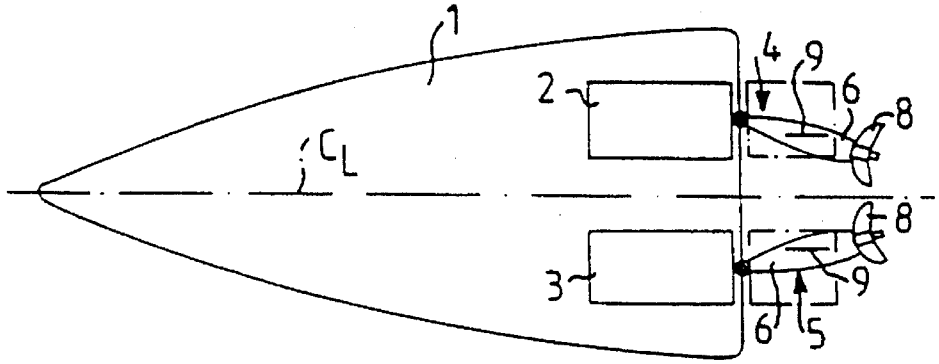
Figure 4:
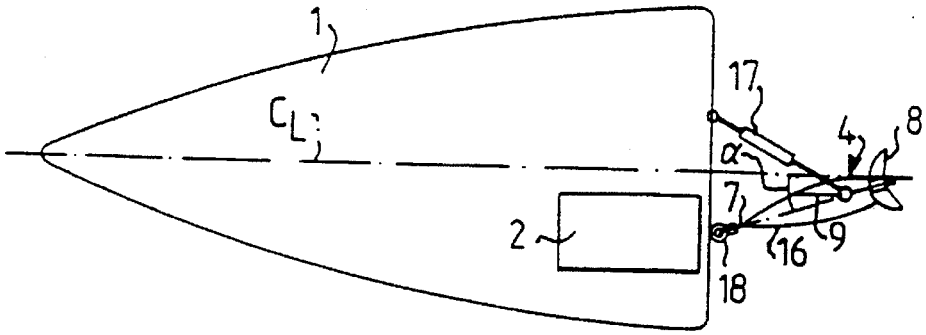
Figure 5:
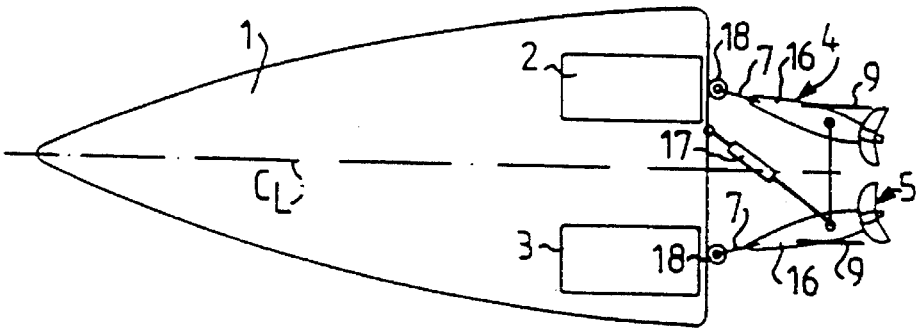

In FIGS. 1–5, reference numeral 1 denotes a boathull, numerals 2 and 3 denote inboard-mounted engines and numerals 4 and 5 denote steerable outboard drive units, for example of an Aquamatic®-type (FIGS. 1–3) and Arneson®-type (FIGS. 4 and 5). Both the engine and the drive installations are of a known type and thus will not be described here in greater detail.

Figure 1:
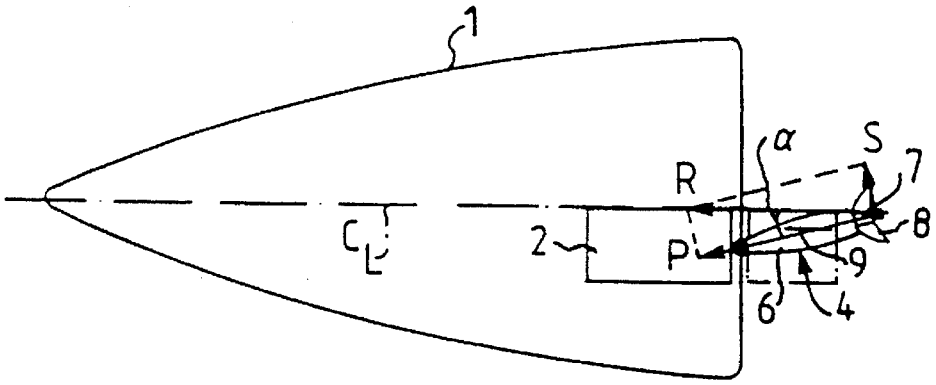
FIGS. 1 to 5 show schematic plan-views of the hull of a vessel with five theoretical alternative embodiments for a drive arrangement.

FIG. 1 shows a drive installation with an engine 2 and an outboard propulsion unit 4 having a gear housing 6 in which a horizontal propeller shaft 7 is rotatably carried. The shaft 7 carries a surface-breaking propeller 8 and is driven by a vertical shaft via an angular gear arrangement (not shown) in the gear housing. The propeller shaft 7 rotates clockwise (seen from astern), whereby the propeller generates a pressure force P and a side force S. The gear housing 6, and consequently also the propeller shaft 7, forms an angle $\alpha$ to the longitudinal centerline $C_L$ of the boathull 1 and a vertical steer fin 9 arranged on the underside of the gear housing 6. The angle $\alpha$ is so chosen that the resultant R of the propeller pressure force and the side force is at least substantially parallel to the longitudinal centerline $C_L$ and the guide fin 9 at the centre point of the propeller.

A boat hull is shown in FIGS. 2 and 3 having twin motors 2, 3 and twin outboard propulsion units 4, 5, the propellers 8 of which rotate in opposite directions. In FIG. 2 the starboard propeller rotates clockwise and the port propeller anti-clockwise (seen from astern). In FIG. 3 the directions of rotation are reversed. Components corresponding to those in FIG. 1 have the same figure reference numerals in FIGS. 2 and 3 as in FIG. 1.

FIG. 4 shows a propeller drive unit 4 of the Arneson®-type which presents a bearing support housing 16 in which a propeller shaft 7 with a surface-breaking propeller 8 is rotatably journalled. The bearing support housing 16 is oriented in the same manner as the above-described gear housing 6, i.e. it forms an angle $\alpha$ to a steer fin 9. The housing 16 is pivotal by means of a hydraulic cylinder 17. The drive from the engine 3 is transmitted to the propeller shaft 7 via a universal joint 18. In FIG. 5 the boat hull is provided with twin engines 2,3 and drive units 4,5. The propellers 8 rotate in opposite directions, corresponding to the installation illustrated in FIG. 3.

Figure 6:
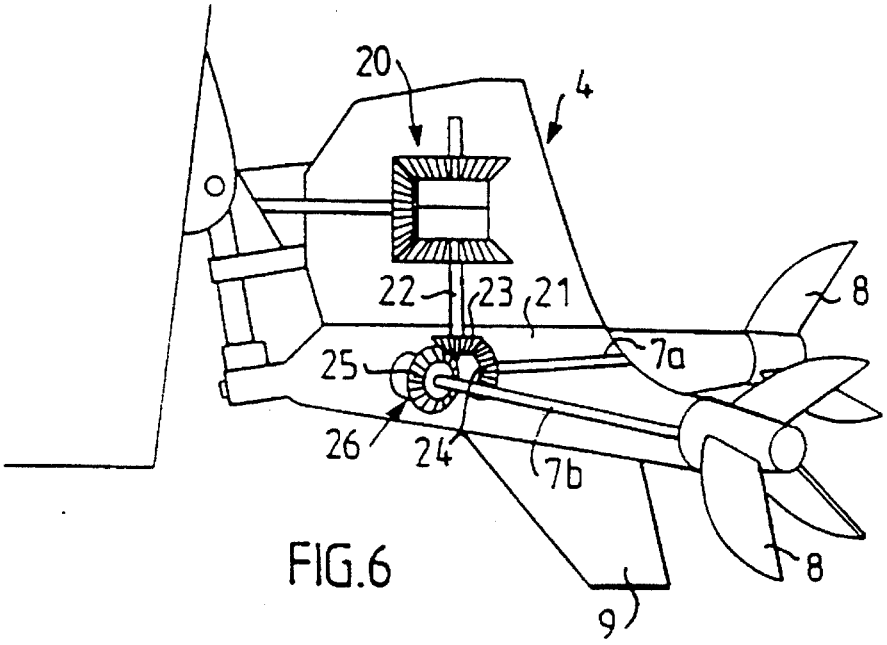
FIGS. 6–8 show schematic elevational views of a steerable propeller drive unit having three alternative angular drive arrangements.
Figure 7:
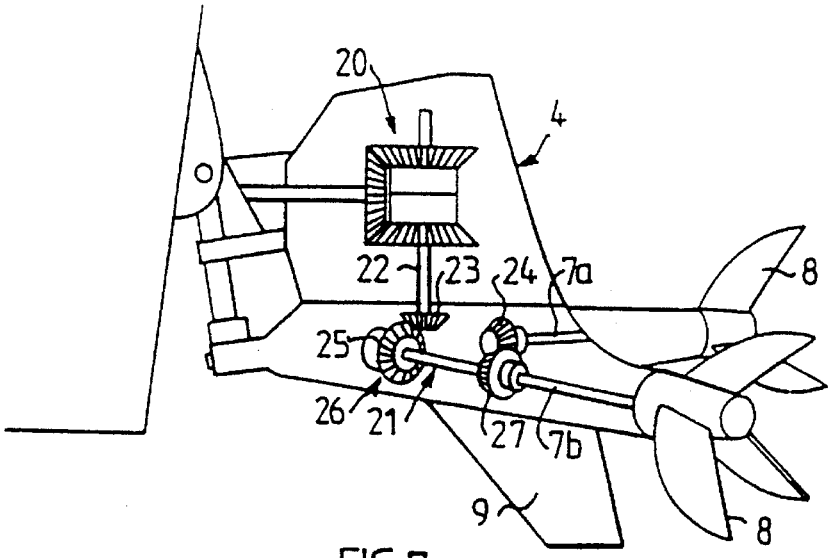
Figure 8:
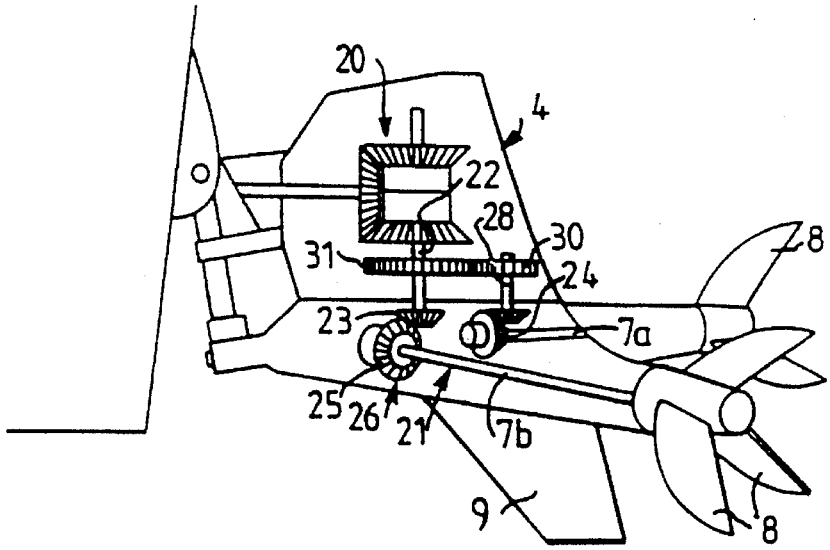

FIGS. 6–8 show a propeller drive unit of the Aquamatic®-type in a further developed embodiment with twin propeller shafts 7*a* and 7*b* supported in a gear housing 26, with each propeller shaft carrying a surface breaking propeller 8. Each shaft 7*a*, 7*b* forms an angle α to a guide fin 9 which, when the boat is travelling straight ahead, is parallel to the longitudinal direction. The propeller shafts 7*a*, 7*b* are driven by a conventional upper angular gear arrangement 20 connected to an engine 4 or 5, the angular gear arrangement including a reverse gear mechanism (not shown) and a lower distribution gear arrangement 21.

In FIG. 6, the distribution gear arrangement 21 comprises a vertical shaft 22 with a lower conical gear wheel 23 meshing with a conical gear wheel 24 and 25 respectively on each of the propeller shafts 7*a* and 7*b*. The one propeller shaft 7*a* is somewhat shorter than the other 7*b*. The distribution gear arrangement 21 is in the form of a hypoid gear arrangement with spiral-cut gear wheels, whereby the rotational axis of the vertical shaft 22 is sidewardly displaced in relation to the rotational axis of the propeller shafts 7*a*, 7*b*, i.e. there is no common intersection point in a single plane. In this manner an optimally compact distribution gear arrangement is obtained, which implies that the volume of the gear housing 26 and thereby its flow resistance is the least possible.

Two alternative compact embodiments of the lower distribution gear arrangement 21 are shown in FIGS. 7 and 8. In the first, the propeller shaft 7*a* is driven via a second gear wheel 27 on the shaft 7*b*, which meshes with the gear wheel 24 on the shaft 6*a*. In the second, the gear wheel 24 meshes with a gear wheel 28 on a second vertical shaft 29 which, via two gear wheels 30, 31, is driven by the first shaft 22. These distribution gears are also formed as hypoid gears.

Figure 9:
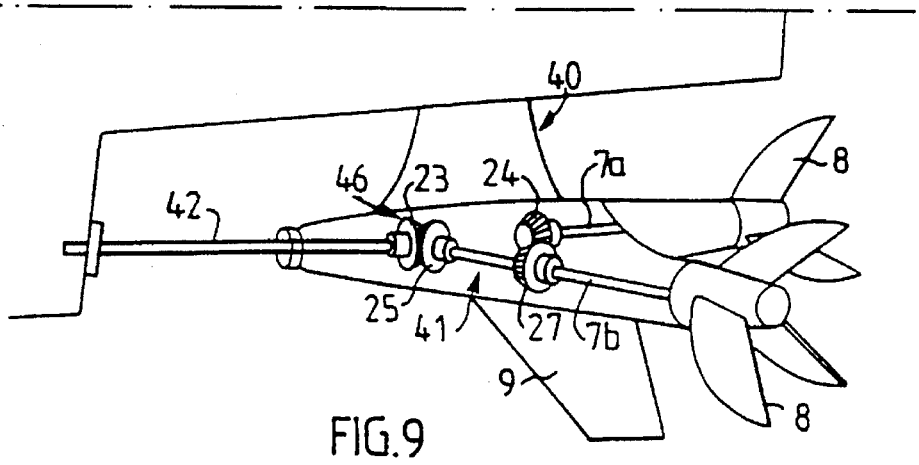
FIG. 9 is a schematic elevational view of a fixed propeller drive unit with a straight distribution gear arrangement.

A propeller drive unit 40 with a gear housing 46 accommodating a distribution gear arrangement 41 is shown in FIG. 9 and is of the same type as that in FIG. 7, though with the difference that the primary shaft 42 from the engine is horizontal. The gear wheels in the arrangement 41 have the same reference numerals as in FIG. 7. The drive unit 40 can be fixed or steerable. In the latter case, a universal joint (not shown) is required to transmit the power from the engine to the propulsion unit 40.

Figure 10:
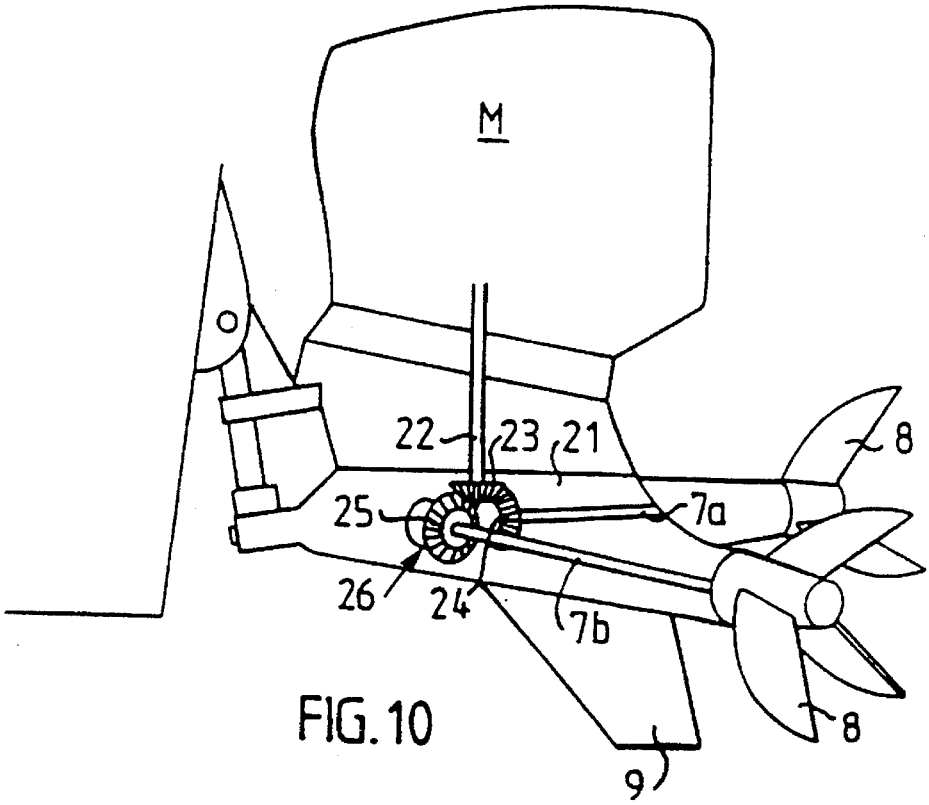
FIG. 10 is an elevational view of a propulsion unit in the form of an outboard motor and FIG. 11 is a schematic elevational view of a steerable propulsion unit having four propellers.

The invention can of course also be applied to purely outboard motors, as indicated by dashed lines in FIGS. 1–3, and as is shown in FIG. 10, where the components corresponding to those in FIG. 6 maintain the same reference numerals as in FIG. 6.

Figure 11:
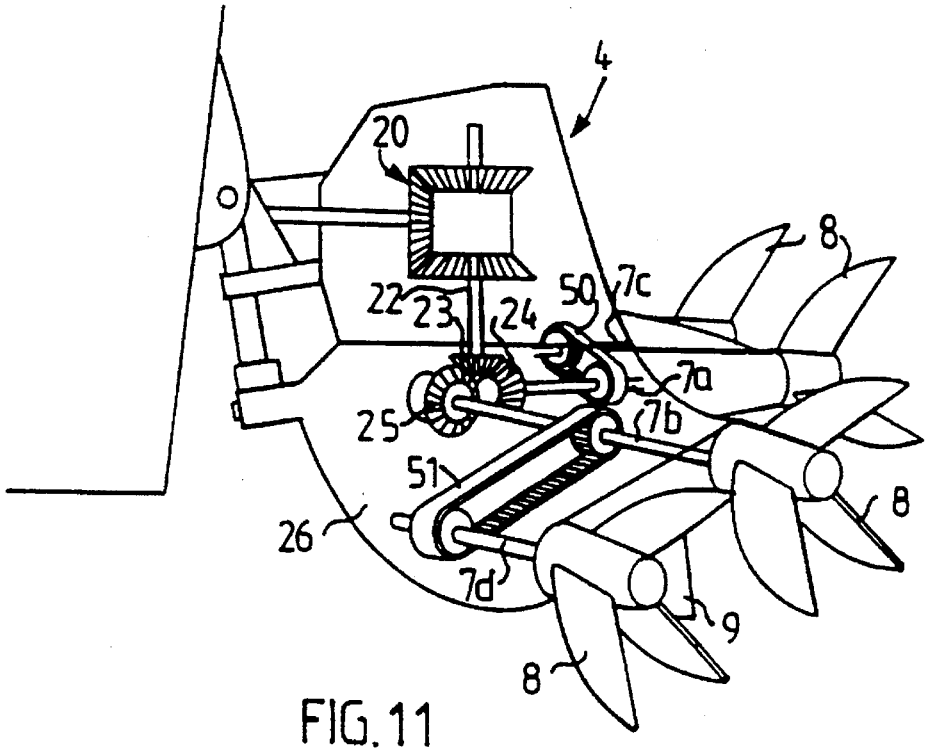

Finally, an embodiment is shown in FIG. 11 having four propellers. The propulsion unit corresponds to that in FIG. 6, though with the difference that two further propeller shafts 7*c*, 7*d* are carried in the housing 26. The shafts 7*c*, 7*d* are parallel to the shafts 7*a*, 7*b* respectively and are driven by the latter by means of toothed belts or a chain transmission 50, 51 respectively. Such a propulsion unit can have its underside shaped so that it acts as a supporting or trimming tab.

All of the above described embodiments can be provided with more than one steer fin. When using for example two steer fins, these do not need to lie in exactly a vertical plane, but can be angled in opposite directions relative to the vertical plane.

In the above described embodiment, a steer fin 9 has been presented as an example of a "flow-control body", with respect to whose plane of symmetry the propeller shaft or shafts are obliquely arranged. The expression "flow-control body" in the appended claims does of course also include other parts of the gear housing of the propulsion unit, a support arm, etc., which has a vertical plane of symmetry which is intended to be aligned with the longitudinal direction of the boat hull when travelling in a straight line.

We claim:

1. Propulsion unit for a marine vessel, the unit comprising a housing connected to a hull of the vessel, a propeller shaft rotatably journalled and connected to transmission means enclosed in the housing, and a surface-breaking propeller mounted on the propeller shaft and located outside an outer end of the housing, wherein in the horizontal plane, the propeller shaft (7; 7*a*, 7*b*, 7*c*, 7*d*) forms a first angle (α) to a vertical plane of symmetry of a water flow-control body (9) directly connected to said housing (6; 26; 46), said flow-control body (9) controlling water flow and being intended to be aligned with a longitudinal extension ($C_L$) of the vessel when the vessel is travelling in a straight line.

2. Propulsion unit according to claim 1, wherein the housing (6; 26; 46) is journalled to a stern of the vessel for pivotal movement in the horizontal plane relative to the stern, and the said flow-control body is in the form of a steer fin (6).

3. Propulsion unit according to claim 1, wherein the housing (6; 26; 46) comprises a gear arrangement (21; 41) between a shaft (22; 42) driven by an engine and the propeller shaft (7; 7*a*, 7*b*).

4. Propulsion unit according to claim 3, wherein the gear arrangement is an angular gear arrangement (21) between a shaft (22) driven by the engine and the propeller shaft (7; 7*a*, 7*b*), these shafts being substantially at right angles to each other.

5. Propulsion unit according to claim 4, wherein the gear arrangement (21) is a hypoid gear arrangement.

6. Propulsion unit according claim 1, wherein said housing (6; 26; 46) forms a part of a drive shaft housing of an outboard propulsion unit (4; 5) which is intended to be connected to an inboard engine (2; 3).

7. Propulsion unit according to claim 1, wherein said housing (6) forms a part of a drive shaft housing of an outboard motor.

8. Propulsion unit according to claim 1, wherein at least two oppositely rotating propeller shafts (7*a*, 7*b*, 7*c*, 7*d*) are carried in the housing (26; 46) in a common substantially horizontal plane and form a second angle (2α) with respect to each other.

9. Propulsion unit according to claim 8, wherein two oppositely rotating propeller shafts (7*a*, 7*b*) are carried in the housing (26; 46).

10. Propulsion unit according to claim 8, wherein two pairs of propeller shafts (7*a*–7*d*) are carried in the housing (26) with the shafts in each respective pair being parallel to each other and wherein one pair of shafts (7*a*, 7*c*) forms an angle to the other pair of shafts (7*b*, 7*d*).

11. Propulsion unit according to claim 8, wherein the housing (26) presents at least one guide fin (9) which lies in a vertical plane and which divides said second angle into two equal angles.

12. Propulsion unit according to claim 1, wherein the angle (α) is so chosen, that the resultant (R) of the propeller pressure force (P) and the side force (S) will be substantially parallel to the longitudinal extension ($C_L$) of the vessel at the center point of the propeller.

* * * * *